United States Patent [19]

Klepesch

[11] Patent Number: 4,655,680

[45] **Date of Patent: * Apr. 7, 1987**

[54] CONTINUOUS BLADE AXIAL-FLOW FRICTION DRAG PUMP

[76] Inventor: Philip H. Klepesch, 5859 Sagebrush Rd., La Jolla, Calif. 92037

[ * ] Notice: The portion of the term of this patent subsequent to Jul. 30, 2002 has been disclaimed.

[21] Appl. No.: 760,318

[22] Filed: Jul. 29, 1985

Related U.S. Application Data

[63] Continuation-in-part of Ser. No. 501,362, Jun. 6, 1983, Pat. No. 4,513,887.

[51] Int. Cl.[4] ..... F01D 5/06

[52] U.S. Cl. ..... 415/90; 415/199.4; 415/1; 416/188

[58] Field of Search ..... 415/76, 77, 90, DIG. 4, 415/199.1, 199.4, 199.5, 198.1, 66, 68; 416/4, 179, 188, 501, 362

[56] References Cited

U.S. PATENT DOCUMENTS

| | | | |
|---|---|---|---|
| 940,103 | 11/1909 | Feld | 415/90 X |
| 1,056,338 | 3/1913 | Johnsen | 415/90 |
| 2,030,560 | 2/1936 | Adams, Jr. | 415/76 X |
| 2,087,834 | 7/1937 | Brown et al. | 415/90 X |
| 2,998,094 | 8/1961 | Hollingsworth | 415/90 X |
| 4,531,887 | 7/1985 | Klepesch | 415/90 |

FOREIGN PATENT DOCUMENTS

| | | | |
|---|---|---|---|
| 1383811 | 2/1975 | United Kingdom | 415/DIG. 4 |
| 729382 | 5/1980 | U.S.S.R. | 415/199.5 |

*Primary Examiner*—Robert E. Garrett
*Assistant Examiner*—Joseph M. Pitko
*Attorney, Agent, or Firm*—Baker, Maxham & Jester

[57] ABSTRACT

An axial flow pump includes multiple axially extending friction drag impellers formed of multiple nestled smooth continuous surface shells having a generally truncated spheroid configuration defining a plurality of axially extending elongated annular channels between the blades that induce fluid flow by means of frictional drag on the fluid.

20 Claims, 10 Drawing Figures

FIG. 1
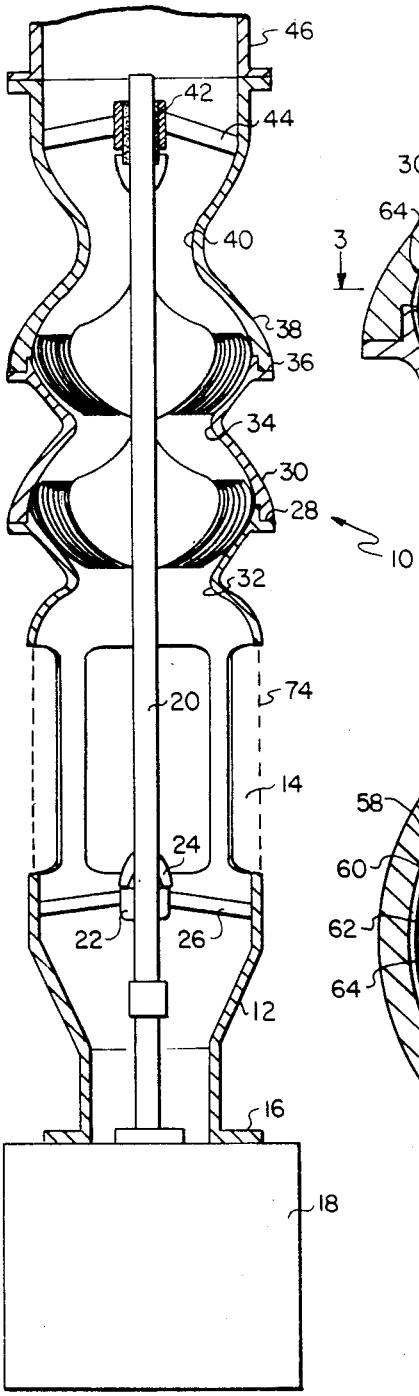
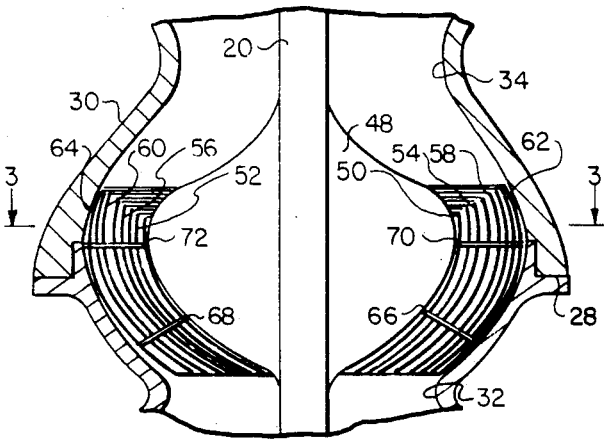
FIG. 2
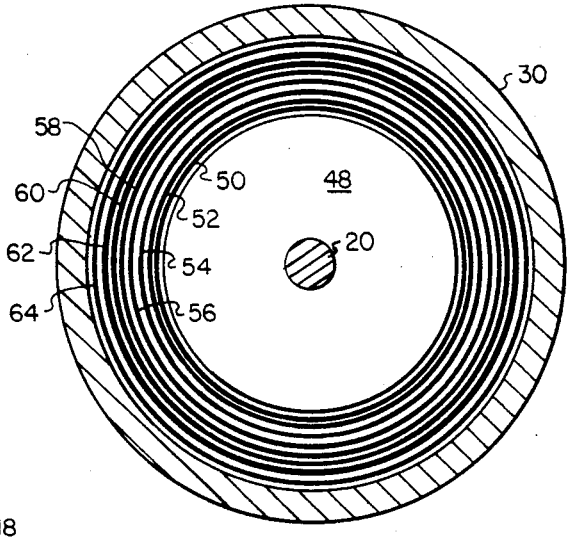
FIG. 3

FIG. 4
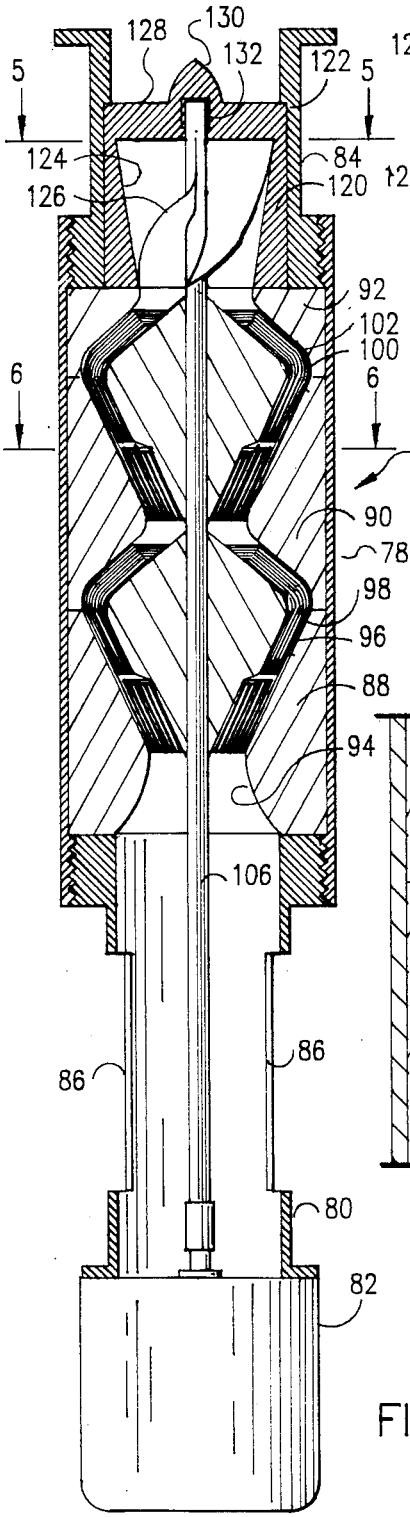
FIG. 7
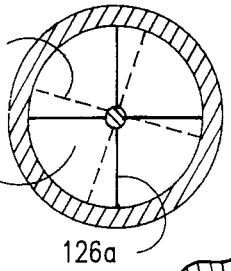
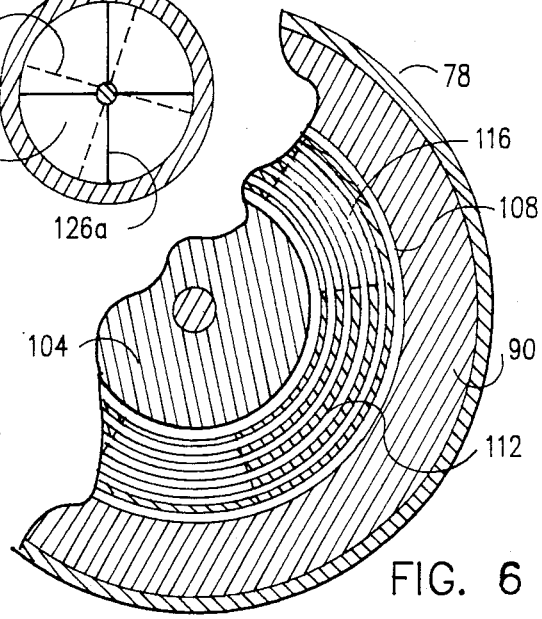
FIG. 6
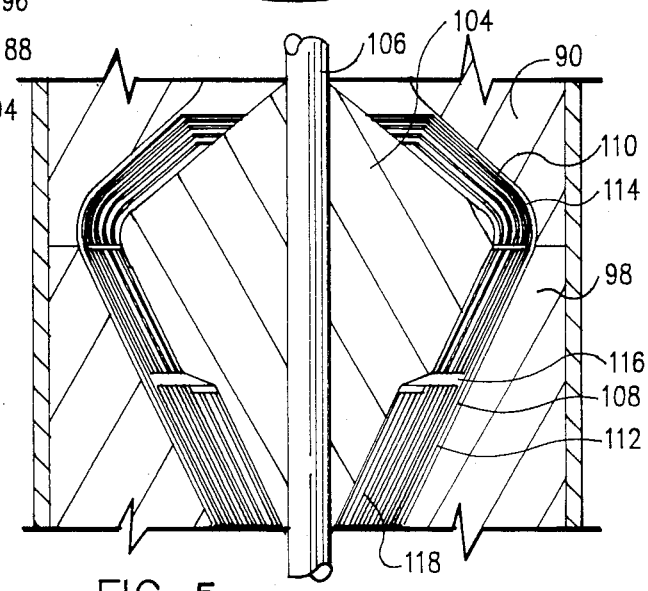
FIG. 5
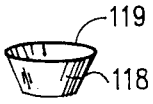
FIG. 8
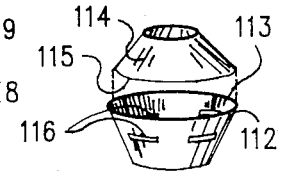
FIG. 9
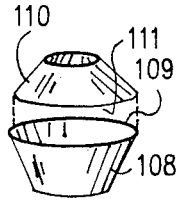
FIG. 10

CONTINUOUS BLADE AXIAL-FLOW FRICTION DRAG PUMP

REFERENCE TO RELATED APPLICATIONS

The present application is a continuation-in-part of my co-pending application Ser. No. 501,362, now U.S. Pat. No. 4,531,887, filed June 6, 1983, entitled "Continuous Blade Multi-Stage Pump".

BACKGROUND OF THE INVENTION

The present invention relates generally to pumps, and pertains particularly to an improved continuous surface friction or boundary layer drag pump.

Rotary disc pumps having smooth surfaces that impose an impelling force on a fluid by means of frictional or boundary layer drag on the fluid were initially proposed by Nicholas Tesla around 1913. Such pumps, however, have been of very little interest, however, due to the lack of efficiency as compared to traditional bladed impeller pumps.

Such pumps which operate on the principle of boundary layer drag have been of interest and proposed for use with certain specific fluids such as human blood. Such application, however, requires low pressure and low force on the fluid.

Pumps operating on this principle, however, are of interest in other applications due to the lack of impediment to the passage of solid particles through the pump. The problem of sufficiently high pressures and efficiencies have, however, continued to be a problem.

In my prior application, I disclosed an improved continuous blade axial flow boundary layer pump. However, I have discovered the need for further improvement in such pumps.

It is therefore desirable that an improved continuous blade axial flow boundary layer pump be available.

SUMMARY AND OBJECTS OF THE INVENTION

It is therefore the primary object of the present invention to provide an improved boundary layer drag pump.

In accordance with the primary aspect of the present invention, a boundary layer drag pump, which imposes an impelling force on a fluid by means of frictional or boundary layer drag on the fluid, includes an impeller rotatably mounted within a housing chamber and including a plurality of concentric shells defining a plurality of axially elongated annular friction surfaces along the rotor with an inlet at one end thereof and an outlet at the other with the annular surfaces increasing from a minimum diameter at the inlet to a maximum diameter intermediate the ends thereof and reducing again from the maximum diameter to an intermediate diameter at the outlet for directing a fluid axially along the impeller and inward toward the axis at the outlet.

BRIEF DESCRIPTION OF THE DRAWINGS

The above and other objects and advantages of the present invention will become apparent from the following description when read in conjunction with the drawings wherein:

FIG. 1 is a side elevation view partially in section showing a preferred embodiment of the invention;

FIG. 2 is an enlarged detail view of one stage of the embodiment of FIG. 1;

FIG. 3 is a section view taken on line 3—3 of FIG. 2;

FIG. 4 is a side elevation view in section of an alternate embodiment of the invention;

FIG. 5 is a partial side elevation view in section of a single stage of the embodiment of FIG. 4 enlarged to show detail;

FIG. 6 is a sectional view taken on line 6—6 of FIG. 4;

FIG. 7 is a sectional view taken on line 7—7 of FIG. 4;

FIG. 8 is a perspective view of a typical stub blade;

FIG. 9 is a perspective view of a typical slotted blade; and

FIG. 10 is a perspective view of a typical full blade.

DETAILED DESCRIPTION OF THE PREFERRED EMBODIMENT

Referring to the drawings, a pump in accordance with the invention is illustrated in FIG. 1 and designated generally by the numeral 10. The illustrated pump is designed as a multi-stage axial flow pump having an elongated multiple part housing. The housing includes a lower generally elongated tubular section 12 having radial inlet ports or openings 14 intermediate the ends. A screen 74 covers the inlet ports or openings. The lower end of the housing includes a flange portion 16 for connection to an electric or other motor 18 for driving the pump. An impeller or rotor shaft 20 is rotatably journaled in a bearing 22 having the usual bearing seal 24. The bearing 22 is supported in a lower bearing support structure 26 of the housing 12.

The housing includes an upper end with an annular flange 28 for cooperative engagement and connection to a first stage impeller housing portion 30 for defining a somewhat spheroidal chamber having a reduced inlet section 32 and a reduced outlet section 34. A second stage chamber is formed by the upper outward flared portion of housing 30 which flares outward to a flange section 36 for attachment to the lower end of an upper housing portion 38 which includes a reduced outlet passage portion 40. The upper housing section 38 includes a journal bearing 42 supported on radial support members 44 for supporting the upper end of the impeller shaft 20. The upper end of the housing 38 opens into a cylindrical pipe or conduit 46 for carrying the pressurized fluid to a desired location.

The impeller of the present pump includes a plurality of continuous substantially smooth surface blades or shells having a generally truncated oblate spheroid configuration nestled together for defining a plurality of axially elongated annular passages extending along the axis of the rotor. These passages are defined by the opposed surfaces of the nestled shells and have an inlet of a first diameter with the passage gradually increasing axially from the inlet end to a maximum diameter intermediate the ends and gradually decreasing from the maximum diameter down to an intermediate diameter at the outlet. The outlet diameter is intermediate that of the maximum diameter and the inlet diameter.

More specifically, as shown in FIG. 2, each of the impellers include a central irregular spheroid 48 mounted on the rotor shaft 20 for rotation therewith. The central nodule 48 supports a plurality of shell-like blades 52 through 64. These shells 52 through 64 have a generally truncated oblate spheroid configuration beginning with the first blade 50 closely spaced from the central nodule 48 and becoming progressively larger outward to the outermost largest shell 64 which is closely spaced inward from the inner surface of the housing. These shells are preferably support from the central nodule 48 by means of a plurality of small radial pins or arms 66, 68, 70 and 72. These provide support of the shell blades, yet present a minor surface to the passage of fluid and/or solid particles along the flow channels of the impeller.

The second stage and any subsequent stage is identical to the first stage with the outlet from the previous stage feeding into the inlet to the subsequent stage. This staging concept or structure can develop a highly efficient high-lift system that greatly increases the lift and pressure developed on a friction impeller-type system.

Referring to FIG. 4 of the drawings, an alternate embodiment is illustrated. This embodiment functions on basically the same principle as in the prior embodiment with somewhat the same internal housing configuration. This embodiment, however, has a number of improvements, including a modular construction, as well as extended impeller plates and additional inlet impeller plates as will be explained.

This embodiment designated generally by the numeral 76 comprises a main housing 78 of a generally cylindrical tubular configuration with a detachable housing portion 80 for mounting a drive motor 82. An outlet housing section 84 connects to the upper end of the main housing 78. The illustrated embodiment, as in the prior embodiment, is designed or illustrated in the configuration of a down hole pump where it has particular advantages.

The housing 80 is provided with a plurality of inlet ports 86 for communicating with the interior thereof for communicating with the axial inlet end of the main housing 78. In the illustrated embodiment, the main housing 78 has a generally cylindrical tubular configuration and includes a plurality of inserts 88, 90 and 92, all of which have a generally cylindrical outer configuration with an inner bore shaped for defining the rotor or impeller chambers.

The housing 88 has a converging inlet 94 and a diverging somewhat conical section outlet end 96. This insert portion mates with the inlet end of housing 90 which has a generally converging section 98 with a similarly diverging section outlet 100. The outlet end of this insert 90 mates with the inlet end of the insert 92 having a converging substantially conically shaped bore 102. These bores form the interior wall surface of the rotor or impeller chambers of the pump.

The rotor or impeller modules are substantially identical in construction and can be any number as desired. Two of the impeller modules are shown defining a two stage pump for illustrative purposes.

Referring specifically to FIG. 5, a rotor module comprises an inner core member 104, which is keyed to a drive shaft 106 and has an outer configuration somewhat conforming to that of the rotor or impeller chamber. A plurality of plates or shells which define the impelling blades or surfaces are mounted concentrically outwardly of the core member 104. The impelling blades are each made up of a diverging inlet plate or blade and a converging outlet plate or blade. The inlet plates are designed to accommodate the changing volume of the impeller from the inlet to the maximum diameter thereof and to reduce cavitation.

More particularly, the blades of the impeller comprises a first inlet blade or plate 108 having an inlet end 109 mated with an inlet end 111 of a first outlet blade or plate 110. These are preferably detachably joined, as can be seen, at the maximum diameter portion of the rotor and at the point of separation of the two housing insert members 88 and 90. The inlet plate 108 is of a diverging frusto-conical configuration with the outlet plate 110 having a somewhat converging frusto-conical configuration with a somewhat axially extending transition portion mating with the outlet edge or tip 109 of the inlet plate or blade 108. Thus, the impeller comprises a diverging inlet section and a converging outlet section.

The angle of the plates with respect to the rotor axis can vary from about fifteen (15) degrees to about seventy-five (75) degrees depending upon the application. In most applications, it is preferred that the outlet plates be at a greater angle than the inlet plates. The angles and diameters of the plates will be determined by the application. For example, a down-hole pump would be restricted in diameter and the angles of the blades may be adjusted accordingly.

A next series of ported inner inlet plates or blades, only one of which, 112 will be specifically described extends from the inlet parallel to the plate 108 and terminates at an outlet edge 113 mating with an inlet edge 115 of an outlet plate 114 at the same essential transition position as the outer plate 108. This plate, however, includes a plurality of ports or passages 116 which permits fluid to flow from the internal surface or space thereof to the outer surface or space thereof. These parallel plates define a passage therebetween that draws and forces the fluid along the impeller plates. A plurality of additional blades identical to blade 112 define additional multiple inlet plates which mate with a corresponding outlet plate 114. The plates become progressively smaller inward toward the inner diameter of the rotor. Any number of plates may be utilized and any selected spacing to obtain the desired flow.

In order to reduce cavitation and enhance flow, an additional plurality of inlet plates, which may be defined as supplemental or stub plates 118, are positioned at the inlet internal of the ported plates. These stub or supplemental plates 118 extend from the inlet of the housing or chamber up to an outlet 119 at a position at or just short of the plurality of ports 116 in the ported inlet plates 112. This provides supplemental flow of fluid to this position which fills the void created by the increasing volume and diameter at the maximum diameter of the rotor or impeller. This construction reduces cavitation and enhances the volume flow for a given size pump. These plates are attached to the rotor member 104 by pins or the like not shown as in the previous embodiment.

An outlet diffuser arrangement as shown in FIG. 4 at the upper end of the pump structure is designed to aid in directing the fluid from the horizontal out of the impeller axially along the axial bore of the outlet of the housing 84. The diffuser arrangement comprises a housing insert member 120 which is retained in position within the member 84 against an upper shoulder 122. This housing structure 84 includes an inner wall structure diverging outward to an outer diameter equivalent to that of the housing 84. A plurality of spiral vanes 126 extend from the lower end of the diffuser to the outlet thereof and are supported out the outer end thereof by a plurality of radial spokes in 128 in hub member 130. These have an upper edge **126*a* and spiral down to a lower edge 126*b* under the next blade. A bearing 231 in the hub member 130 supports the upper end of the drive shaft 106**.

The basic theory of the operation of the present pump is basically the same as the original as shown in FIGS. 1–3. However, the system has a number of advantages.

The pump works on a boundary drag layer principle in that the friction between the surfaces of the blades and the layer of fluid adjacent to the blade results in a specific depth of fluid being dragged along with a blade and also adds energy to the fluid. This forms a velocity vector that is perpendicular to radii from the shaft, i.e. circles around the shaft. Another velocity vector is developed by the centrifugal force which acts radially out from the shaft and also upward due to the increasing radius of each blade. Thus, the combination of the boundary layer drag and this centrifugal force not only propels the fluid in a strongly rotational flow but moves it upward or axially along from the inlet of the housing to the outlet of each state of the pump.

The pump can have any number of different stages. It may have from one up to as many that may be required for obtaining the necessary head or the like or as limited by shaft or motor constraints. The second and any subsequent stage would be identical in structure to the previous stage.

The system works on the so called friction or boundary layer principle in that the friction (or molecular attraction) between the surfaces of the blades and the layer of fluid adjacent the blade operates to drag the fluid along with the blade. As the blade rotates, it pulls the fluid along with the fluid rotating with the blade and channelled radially outward under the influence of centrifugal force, forcing the fluid rapidly outward and upward to the maximum diameter of the fluid passage or channels of the rotor with the fluid continuing to move under high velocity (pressure) out the outlet end of the impeller into the inlet of the next stage and adds energy to the fluid.

Thus, the combination of the friction or boundary layer drag and the centrifugal force propels the fluid along from the inlet to the outlet of each stage of the pump. The blades are each of a shell-like construction as previously explained with the inner and outer surfaces being substantially smooth with no external or extending blade structure.

The blades or shells can be spaced at substantially any desired distance apart. It will be apparent, however, that the minimum space and maximum number of blades with maximum surface imposes the greatest amount of force on the fluid. Therefore, with greater space between the blades with a given fluid, the force on the blade or on the fluid by means of the blade will be substantially less. The viscosity of the fluid is also a factor that will determine the pressure and efficiency of the pump with that particular fluid.

The pump is primarily designed and is most efficient with liquids, however, it should be understood that it can also be utilized for the pumping of gases.

As previously explained, the fluid is propelled along by means of force from the rotational drag or friction action of the blades. Another velocity vector or factor is that from centrifugal force as the fluid is forced outward from the base of the blades and directed upward by the directional surfaces of the blades. Since the surface velocity of the blade increases as it angles away from the shaft, it also transmits this velocity change to the fluid. The inward curved top of the blade brings fluid smoothly back in line with the discharge channel and the inlet port to the next stage and adds energy to fluid.

The number of stages and the thickness, height, angle and curvature of the blades as well as the spaces, rotational speed, etc. are to be considered as functions of the viscosity of the fluid, the head required, and the flow rate required. Many of these parameters will also be affected by the space available for the pump.

The pump can be utilized in any substantial or typical configuration, such as a submersible pump or in-line configuration.

While I have illustrated and described my invention by means of specific embodiments, it is to be understood that numerous changes and modifications made be made therein without departing from the spirit and scope of the invention as defined in the appended claims.

I claim:

1. An axial flow fluid pump, said pump comprising:

a housing defining an impeller chamber having an axis;

an inlet at one end of said chamber and an outlet at the other end of said chamber;

an axial impeller rotatably mounted coaxially in said chamber and comprising shell means having an inlet opening and an outlet opening and defining an axially extending annular flow channel defined by axially extending opposed walls and having a first diameter at said inlet and diverging outward in diameter from said inlet to a position of maximum diameter axially along said impeller toward said outlet and converging inward in diameter from said maximum diameter toward said axis to an outlet diameter intermediate said inlet and maximum diameters.

2. An axial flow pump according to claim 1 wherein:

said impeller comprises a plurality of thin smooth surface plates comprising a plurality of diverging inlet plates and a plurality of converging outlet plates.

3. An axial flow pump according to claim 2 wherein a plurality of said inlet plates axially abut said outlet plates.

4. An axial flow pump according to claim 3 wherein said inlet plates are frusto-conical in configuration.

5. An axial flow pump according to claim 2 wherein said inlet plates are greater in number than said outlet plates.

6. An axial flow pump according to claim 5 wherein a first plurality of said inlet plates have ports therethrough intermediate the ends thereof.

7. An axial flow pump according to claim 6 wherein a second plurality of said inlet plates extend from said inlet to said ports in said first plurality of said plates.

8. An axial flow pump according to claim 2 wherein said inlet opening is less than one-half said maximum diameter, and said outlet diameter is about one-half said maximum diameter.

9. An axial flow pump according to claim 8 wherein said inlet plate and said outlet plates are frusto-conical in configuration.

10. An axial flow pump according to claim 9 wherein said inlet plates extend at an angle of between about fifteen to seventy-five degrees and said outlet plates extend at an angle of between about fifteen and seventy-five degrees to said axis.

11. An axial flow frictional impeller fluid pump, said pump comprising:

a housing defining an impeller chamber having an axis;

an inlet at one end of said chamber and an outlet at the other end of said chamber;

an impeller rotatably mounted coaxially in said chamber and comprising a plurality of axially extending concentrically mounted shells having an inlet at one end and an outlet at the other end and defining annular flow channel by axially extending continuous surface opposed walls and having a first inlet diameter and diverging outward diameter from said inlet to a position of maximum diameter axially along said rotor toward said outlet and converging inward in diameter from said maximum diameter toward said axis to an outlet diameter intermediate said inlet and maximum diameters.

12. An axial flow pump according to claim 11 wherein:

said impeller comprises a plurality of thin smooth surface plates comprising a plurality of diverging frusto-conical inlet plates and a plurality of converging frusto-conical outlet plates; and, a plurality of said inlet plates abut said outlet plates.

13. An axial flow pump according to claim 12 wherein said inlet plates are greater in number than said outlet plates.

14. An axial flow pump according to claim 13 wherein:

a first plurality of said inlet plates have ports therethrough intermediate the ends thereof; and, a second plurality of said inlet plates extend from said inlet to said ports in said first plurality of said plates.

15. A axial flow pump according to claim 14 comprising a diffuser at the outlet to said housing, said diffuser having a plurality of axially spiraling vanes for directing fluid from said impeller axially therefrom.

16. An axial flow pump according to claim 14 wherein:

the angle of the inlet plates is between fifteen and seventy-five degrees to the impeller axis; and, the angle of the outlet plates is between fifteen and seventy-five degrees to said impeller axis and greater than the angle of the inlet plates.

17. An axial flow frictional impeller fluid pump, said pump comprising:

a housing defining an impeller chamber having an axis;

an inlet at one end of said chamber and an outlet at the other end of said chamber;

an impeller rotatably mounted coaxially in said chamber and comprising a plurality of axially extending concentrically mounted diverging inlet shells having an inlet at one end and an outlet at the other end and and a plurality concentrically mounted converging outlet shells mounted coaxially of said inlet shells.

18. An axial flow pump according to claim 17 wherein:

said inlet shells and said outlet shells are generally frusto-conical in configuration; and each have an angle of between about fifteen and seventy-five degrees with respect to the axis thereof, with said outlet shell having a greater angle than said inlet shell.

19. An axial flow pump according to claim 18 comprising an outlet diffuser for directing circular flow from said impeller to axial flow from the outlet of said housing.

20. An axial flow pump according to claim 17 wherein:

a plurality of said inlet shells have ports therethrough between the inlet and the outlet thereof; and another plurality of said inlet shells extend from said inlet to said ports.

* * * * *